US012312831B2

(12) United States Patent
King et al.

(10) Patent No.: US 12,312,831 B2
(45) Date of Patent: May 27, 2025

(54) POOL COVER

(71) Applicant: Groupe Solmax, Inc., Varennes (CA)

(72) Inventors: Kevin Nelson King, Mount Airy, GA (US); David Michael Jones, Buford, GA (US)

(73) Assignee: Nicolon Corporation, Pendergrass (GE)

( * ) Notice: Subject to any disclaimer, the term of this patent is extended or adjusted under 35 U.S.C. 154(b) by 0 days.

(21) Appl. No.: 18/360,994

(22) Filed: Jul. 28, 2023

(65) Prior Publication Data

US 2025/0034893 A1 Jan. 30, 2025

(51) Int. Cl.

| | |
|---|---|
| ***E04H 4/10*** | (2006.01) |
| ***D03D 13/00*** | (2006.01) |
| ***D03D 15/527*** | (2021.01) |
| ***D03D 23/00*** | (2006.01) |

(52) U.S. Cl.

CPC ..... *E04H 4/10* (2013.01); *D03D 13/004* (2013.01); *D03D 15/527* (2021.01); *D03D 23/00* (2013.01)

(58) Field of Classification Search

CPC ..... E04H 4/10; D03D 15/527; D03D 13/004; D03D 23/00; D10B 2403/00; D10B 2401/22; A01G 9/22

USPC ..... 4/498; 428/58, 98, 196, 221, 222; 442/111, 175, 181, 203, 239

See application file for complete search history.

(56) References Cited

U.S. PATENT DOCUMENTS 2,269,321 A * 1/1942 Scheuer ..... D03D 23/00 139/417
2,870,455 A * 1/1959 Charles ..... E04H 4/10 139/420 R
3,593,757 A * 7/1971 Haynes ..... D03D 9/00 139/420 R
4,002,188 A * 1/1977 Hanks ..... D03D 9/00 139/420 C
6,836,907 B1 * 1/2005 Pesta ..... E04H 4/10 428/109

(Continued)

FOREIGN PATENT DOCUMENTS

EP 3029186 A1 * 6/2016
WO 2004/044338 A1 5/2004

OTHER PUBLICATIONS

International Search Report and Written Opinion—PCT Application No. 2023/057704, dated Sep. 21, 2023.

(Continued)

*Primary Examiner* — Erin Deery
*Assistant Examiner* — William R Klotz
(74) *Attorney, Agent, or Firm* — Barnes & Thornburg; Tina M. Dorr

(57) ABSTRACT

A woven pool cover fabric that includes a repeating geometric pattern with a plurality of first lines in a warp direction and plurality of second lines in a fill direction that cross one another to form a plurality of repeating geometric shapes. The plurality of geometric shapes being a first geometric shape and a second geometric shape that alternate across each of the first lines and second lines. The woven pool cover fabric further includes a water flow rate of about 10 gallons/minute per square foot to about 200 gallons/minute per square foot as measured by ASTM D4491 test method, and has a shade coverage of about 80% to about 99%.

3 Claims, 2 Drawing Sheets

(56) References Cited

U.S. PATENT DOCUMENTS

| | | | | |
|---|---|---|---|---|
| 6,886,187 | B2 * | 5/2005 | Zell | E04H 4/10 4/498 |
| 10,024,022 | B2 * | 7/2018 | Booth | D03D 13/008 |
| 10,829,873 | B2 * | 11/2020 | Jones | D03D 15/46 |
| 2005/0055760 | A1 | 3/2005 | Sutton et al. | |
| 2005/0241056 | A1 | 11/2005 | Zell et al. | |
| 2007/0277897 | A1 | 12/2007 | King | |
| 2009/0304974 | A1 * | 12/2009 | Tick | B44F 3/00 428/196 |
| 2016/0298271 | A1 * | 10/2016 | Salama | D03D 1/0052 |
| 2016/0348333 | A1 * | 12/2016 | Sutton | E01C 3/003 |
| 2022/0259776 | A1 * | 8/2022 | Sutton | D03D 13/008 |

OTHER PUBLICATIONS

"Standard Test Methods for Water Permeability of Geotextiles by Permittivity"; ASTM International; Jun. 1, 2020; pp. 1-8; D4491/D4491M-20; Pennsylvania, US.

"Standard Test Method for Trapezoid Tearing Strength of Geotextiles"; ASTM International; Jan. 1, 2015; pp. 1-6; D4533/D4533M-15; Pennsylvania, US.

"Standard Test Method for Grab Breaking Load and Elongation of Geotextiles"; ASTM International; May 15, 2015; pp. 1-5; D4632/D4632M-15a; Pennsylvania, US.

"Standard Test Method for Measuring the Nominal Thickness of Geosynthetics"; ASTM International; Jun. 15, 2019; pp. 1-4; D5199-12 (Reapproved 2019); Pennsylvania, US.

"Standard Test Method for Measuring the Light Penetration of a Rolled Erosion Control Product (RECP)"; ASTM International; Jul. 1, 2017; pp. 1-5; D6567-17; Pennsylvania, US.

* cited by examiner

POOL COVER

BACKGROUND

The present disclosure relates to pool cover fabrics, and more specifically to, texturized, patterned, woven pool cover fabrics with high water flow rates and shade coverage.

A woven pool cover fabric is a swimming pool accessory made of polymeric yarns woven into a protective blanket that selectively covers the open top surface of a swimming pool. Typically, a woven pool cover is anchored into the pool deck but could also be rolled up onto a spool or roller to uncover the swimming pool while in use. The cover can then unroll and cover the pool while not in use.

Woven pool cover fabrics provide advantages of reducing pool water evaporation, which mitigate overall heat loss from the pool. Such pool cover fabrics also keep debris, such as leaves and dirt, out of the water, thereby reducing maintenance. Further, the pool cover fabrics are a safety mechanism to prevent children and small animals from falling into the potentially dangerous pool water.

A woven pool cover fabric extends across the width of the pool and is sometimes wound on a roller suspended from each side of the pool. To cover the pool, the cover is unwound and floated on the water from one end to the other. To use the pool, the roller winds the blanket up to expose the water underneath. Alternatively, automatic pool cover fabrics are built into in-ground pools and provide a load-bearing cover over the pool.

SUMMARY

According to embodiments, a woven pool cover fabric includes a repeating geometric pattern with a plurality of first lines in a warp direction and plurality of second lines in a fill direction that cross one another to form a plurality of repeating geometric shapes. The plurality of geometric shapes is a first geometric shape and a second geometric shape that alternate across each of the first lines and second lines. The woven pool cover fabric further includes a water flow rate of about 10 gallons/minute per square foot to about 200 gallons/minute per square foot as measured by ASTM D4491 test method, and has a shade coverage of about 80% to about 99%.

According to other embodiments, a method of making a woven pool cover fabric includes weaving a fabric that includes a repeating geometric pattern with plurality of first lines in a warp direction and plurality of second lines in a fill direction that cross one another to form a plurality of repeating geometric shapes. The plurality of geometric shapes is a first geometric shape and a second geometric shape that alternate across each of the first lines and second lines. The woven pool cover fabric includes a water flow rate of about 10 gallons/minute per square foot to about 200 gallons/minute per square foot as measured by ASTM D4491 test method, and has a shade coverage of about 80% to about 99%.

Yet, according to other embodiments, a method of covering a pool includes extending or laying a woven pool cover fabric over a pool opening. The fabric includes a repeating geometric pattern with plurality of first lines in a warp direction and plurality of second lines in a fill direction that cross one another to form a plurality of repeating geometric shapes. The plurality of geometric shapes is a first geometric shape and a second geometric shape that alternate across each of the first lines and second lines. The fabric has a water flow rate of about 10 gallons/minute per square foot to about 200 gallons/minute per square foot as measured by ASTM D4491 test, and a shade coverage of about 80% to about 99%.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Woven pool cover fabrics must provide sufficient shade to prevent light from penetrating through the fabric to the pool water, which would encourage undesired algae growth in the pool. While providing such high shade coverage is required, and 100% shade coverage is would be ideal, woven pool cover fabrics have inherent openings between woven yarns and therefore cannot provide 100% shade coverage. Further, woven pool cover fabrics made from yarns that are heavy enough and tightly woven enough to provide such high shade coverage are heavy, which is undesired because they are challenging to transport and undesirably encourage standing water on top of the pool cover, requiring an extra pump to remove the standing water.

Accordingly, described herein are woven pool cover fabrics and methods of making and using thereof, that address the foregoing challenges. The woven pool cover fabrics are texturized and patterned. According to embodiments, a woven pool cover fabric includes a repeating geometric pattern with a plurality of first lines in a warp direction and plurality of second lines in a fill direction that cross one another to form a plurality of repeating geometric shapes. The plurality of geometric shapes is a first geometric shape and a second geometric shape that alternate across each of the first lines and second lines. The woven pool cover also has a water flow rate of about 10 gallons/minute per square foot to about 200 gallons/minute per square foot as measured by ASTM D4491 test, and a shade coverage of about 80% to about 99%.

The woven pool cover fabric unexpectedly has both a high water flow rate and a high shade coverage, simultaneous properties that are typically diametrically opposed to one another. Typically, increasing water flow through a woven fabric results in decreased shade coverage because in order to increase water flow, the fabric must be woven with openings to allow water to pass. As such, these openings allow sunlight to penetrate through the cover, and therefore, allow sunlight to reach the pool water. However, the woven pool cover fabrics described herein are woven with a repeating pattern of shapes, which are the same or different weaves, that unexpectedly provides both increased water flow and shade coverage compared to conventional woven pool cover fabrics, which do not have such repeating patterns and textures.

Figure 1:
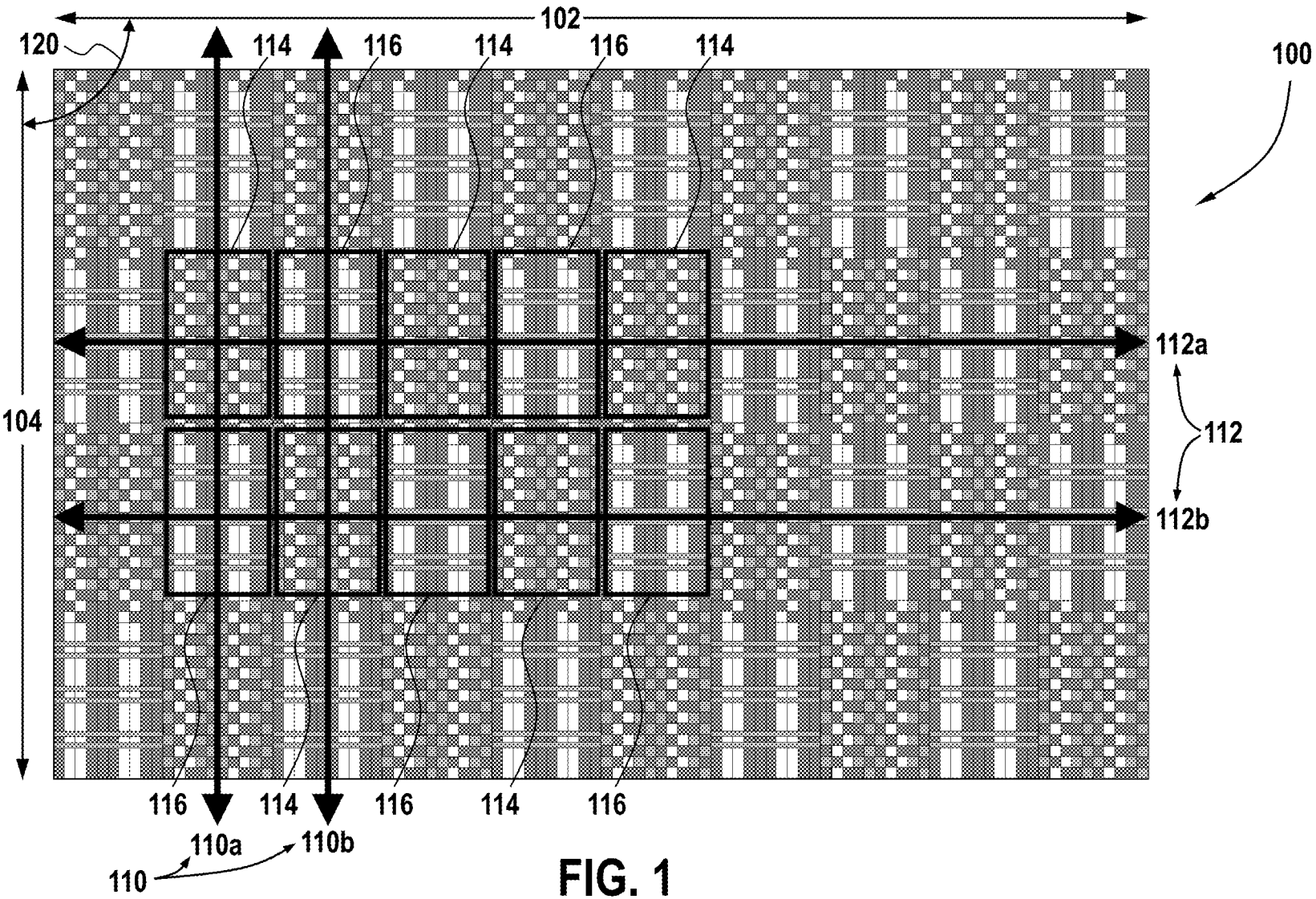
FIG. 1 is a top view of a woven pool cover fabric according to embodiments.

FIG. 1 illustrates a woven pool cover fabric 100 according to embodiments. The woven pool cover fabric 100 has a warp direction 104 and a fill direction 102. The warp direction 104 and the fill direction 102 (also referred to as the weft direction) are principle directions of the woven fabric. The warp direction 104 is the length wise, or machine direction (MD) of the fabric. The fill direction 102 is the direction across the fabric, from edge to edge, or the direction traversing the width of the weaving machine (i.e., the cross machine direction, CD). Thus, the warp and fill directions are generally perpendicular to each other. The set of yarns, threads, or monofilaments running in each direction are referred to as the warp yarns and the fill yarns, respectively. The woven pool cover fabric 100 includes one or more types of yarns, threads, and/or monofilaments in each of the warp direction 104 and fill direction 102.

The woven pool fabric 100 has a repeating geometric pattern with a plurality of first lines 110 in a warp direction 104 and plurality of second lines 112 in a fill direction 102 that cross one another to form a plurality of repeating geometric shapes, described below. In one or more embodiments, the first lines 110 in the warp direction 104 and the second lines 112 in the fill direction 102 cross one another to form perpendicular angles 120. In other embodiments, the first lines 110 in the warp direction 104 and the second lines in the fill direction 102 form angles that are not perpendicular and are therefore more than 90 degrees, less than 90 degrees, or oblique angles.

The crossing of the first lines 110 and second lines 112 form the repeating geometric pattern of plurality of geometric shapes. The plurality of geometric shapes is defined as a first geometric shape 114 and a second geometric shape 116 that alternate across each of the first lines 110 in the warp direction 104 and second lines 112 in the fill direction 102. Each first line 110 in the warp direction 104 includes alternating first geometric shape 114 and second geometric shape 116 in sequential order, i.e., first geometric shape 114, second geometric shape 116, first geometric shape 114, and second geometric shape 116. Each second line 112 in the weft direction also includes alternating first geometric shape 114 and second geometric shape 116 in sequential order, i.e., first geometric shape 114, second geometric shape 116, first geometric shape 114, and second geometric shape 116. In the repeating pattern, each first shape 114 is directly adjacent to a second shape 116 on all sides, such that first shapes 114 alternate with second shapes 116 in a repeating pattern in both the warp direction 104 and the fill direction 102. In embodiments, the first shape 114 does not directly contact another first shape 114 in another first line 110 or second line 112.

The resulting repeating pattern is a checkerboard pattern in one or more embodiments, with the same or different first and second geometric shapes 114, 116, with the sameness or differentness being the difference in size, shape, and/or weaving pattern, as further described below. In embodiments, the first geometric shape 114, the second geometric shape 116, or both, is, independently, a rectangle, a square, or a polygon. In FIG. 1, the first geometric shape 114 is a rectangle, and the second geometric shape 116 is a rectangle.

The first geometric shape 114 and the second geometric shape 116 have dimensions that are not intended to be limited and depend on the overall dimensions of the woven pool cover fabric and the pool onto which the fabric covers. In some embodiments, each of or both of the first geometric shape 114 and the second geometric shape 116 has perimeter dimensions of about 0.25 to about 3 inches in a first direction by about 0.25 to about 3 inches in a second direction. In other embodiments, the first geometric shape 114, the second geometric shape 116, or both, has a perimeter dimension about or in any range between about 0.25, 0.5, 0.75, 1, 1.25, 1.5, 1.75, 2, 2.25, 2.5, 2.75, and 3 inches in first direction. In other embodiments, the first geometric shape 114, the second geometric shape 116, or both, has a perimeter dimension about or in any range between about 0.25, 0.5, 0.75, 1, 1.25, 1.5, 1.75, 2, 2.25, 2.5, 2.75, and 3 inches in second direction. In one or more embodiments, the first direction is the warp direction 104, and the second direction is the fill direction 102. In other embodiments, the first direction is in direction that is offset or different from the warp direction 104, and the second direction is in a direction that is offset or different from the fill direction 110.

In embodiments, the first geometric shape 114 in a first line 110*a* of the plurality of first lines 110 is offset in the warp direction 104 with respect the first geometric shape 114 in a second line 110*b* of a plurality of first lines 110 that is successive with the first line 110*a* of the plurality of first lines 110. In embodiments, directly adjacent first lines 110*a*, 110*b* in a series of first lines 110 have first geometric shapes 114 that are offset in the warp direction 104 with respect to one another such that the first geometric shapes 114 are not directly adjacent to one another, or not stacked upon one another.

In embodiments, the second geometric shape 116 in the first line 110*a* of the plurality of first lines 110 is offset in the warp direction 104 with respect the second geometric shape 116 in the second line 110*b* of the plurality of second lines 110 that is successive with the first line 110*a* of the plurality of first lines 110. In embodiments, directly adjacent first lines 110*a*, 110*b* in a series of first lines 110 have second geometric shapes 116 that are offset in the warp direction 104 with respect to one another such that the second geometric shapes 116 are not directly adjacent to one another, or not directly stacked upon one another.

In some embodiments, each of the first geometric shape 114 and second geometric shape 116 are offset in warp direction 104 in the successive first and second lines 110*a*, 110*b* of the plurality of first lines 110 in the warp direction 104 by at least one pick. A "pick" is a single fill yarn.

In embodiments, the first geometric shape 114 in a first line 112*a* of the plurality of second lines 112 is offset in the fill direction 102 with respect the first geometric shape 114 in a second line 112*b* of a plurality of first lines 112 that is successive with the first line 112*a* of the plurality of second lines 112. In embodiments, directly adjacent first and second lines 112*a*, 112*b* in a series of second lines 112 have first geometric shapes 114 that are offset in the fill direction 102 with respect to one another such that the first geometric shapes 114 are not directly stacked upon one another, or not directly adjacent to one another.

In embodiments, the second geometric shape 116 in the first line 112*a* of the plurality of second lines 112 is offset in the fill direction 102 with respect the second geometric shape 116 in the second line 112*b* of the plurality of second lines 112 that is successive with the first line 112*a* of the plurality of second lines 112. In embodiments, directly adjacent first and second lines 112*a*, 112*b* in a series of second lines 112 have second geometric shapes 116 that are offset in the fill direction 102 with respect to one another such that the second geometric shapes 116 are not directly stacked upon one another, or not directly stacked upon one another.

In some embodiments, each of the first geometric shape 114 and second geometric shape 116 is offset in the successive first and second lines 112*a*, 112*b* of the plurality of second lines 112 in the fill direction 102 by at least one pick.

In embodiments, the first geometric shape 114 has a weave pattern that is different from a weave pattern of the second geometric shape 116. In other embodiments, the first geometric shape 114 has a weave pattern that is the same as the weave pattern of the second geometric shape 116. Non-limiting examples of weave patterns for each of the first geometric shape 114 and second geometric shape 116 are a plain weave pattern, a twill weave pattern, or a basket weave pattern. However, such patterns for the weave patterns of the first geometric shape 114 and second geometric shape 116 are only illustrative, and the invention is not limited to such patterns The weave pattern of fabric construction is the pattern in which the warp yarns are interlaced with the fill yarns. A woven fabric is characterized by an interlacing of these yarns. The term "shed" is derived from the temporary separation between upper and lower warp yarns through which the fill yarns are woven during the weaving process. The shed allows the fill yarns to interlace into the warp yarns to create the woven fabric. By separating some of the warp yarns from the others, a shuttle can carry the fill yarns through the shed, for example, perpendicularly to the warp yarns. As known in weaving, the warp yarns that are raised and the warp yarns that are lowered, respectively, become the lowered warp yarns and the raised warp yarns after each pass of the shuttle. During the weaving process, the shed is raised; the shuttle carries the weft yarns through the shed; the shed is closed; and the fill yarns are pressed into place. Accordingly, as used herein with respect to the woven fabric, the term "shed" means a respective fill set which is bracketed by warp yarns.

A plain weave is characterized by a repeating pattern where each warp yarn is woven over one fill yarn and then woven under the next fill yarn.

A twill weave, relative to the plain weave, has fewer interlacings in a given area. A twill weave is named by the number of fill yarns that a single warp yarn goes over and then under. For example, in a 2/2 twill weave, a single warp end weaves over two fill yarns and then under two fill yarns. In a 3/1 twill weave, a single warp end weaves over three fill yarns and then under one fill yarn. For fabrics being constructed from the same type and size of yarn, with the same thread or monofilament densities, a twill weave has fewer interlacings per area than a corresponding plain weave fabric.

In one or more embodiments, the weave pattern of the first geometric shape 114, the second geometric shape 116, or both, is a ⅓ twill weave, a 2/1 twill weave, a 2/2 twill weave, or a 3/1 twill weave.

In embodiments, the first geometric shape 114 has a plain weave pattern, and the second geometric shape 116 has a twill weave pattern, which is a ⅓ twill weave, a 2/1 twill weave, a 2/2 twill weave, or a 3/1 twill weave.

The woven pool cover fabric is constructed so that the number of ends in the warp direction 104 is about 15 ends per inch to about 50 ends per inch. "Ends" refer to the number of yarns. In other embodiments, the number of ends in the warp direction 104 is about 30 ends per inch to about 45 ends per inch. In some embodiments, the number of ends in the warp direction 104 is about or in any range between about 15, 20, 25, 30, 35, 40, 45, and 50 ends per inch.

The fill 102 of the woven pool cover fabric has a number of picks in the range from about 8 per inch to about 40 per inch. "Picks" refer to the number of yarns. In other embodiments, the number of picks in the fill direction 102 is about 20 picks per inch to about 30 picks per inch. Yet, in other embodiments, the number of picks in the fill direction 102 is about or any range between about 8, 10, 12, 14, 16, 18, 20, 22, 24, 26, 28, 30, 32, 34, 36, 38, and 40 picks per inch.

Figure 2:
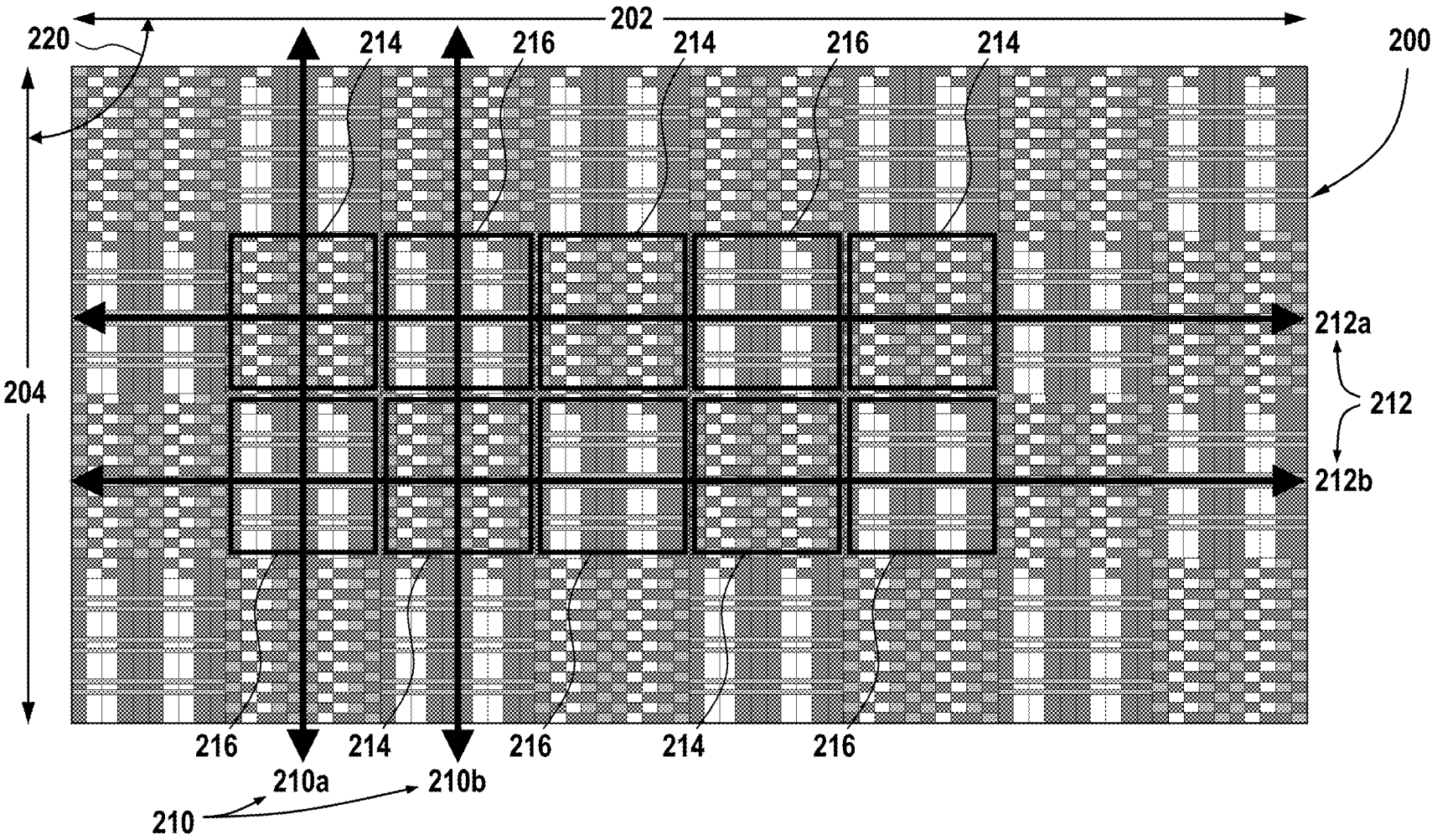
FIG. 2 is a top view of another woven pool cover fabric according to embodiments.

FIG. 2 illustrates a woven pool cover fabric 200 according to embodiments. The woven pool cover fabric 200 has a warp direction 204 and a fill direction 202. The warp direction 204 and the fill direction 102 (also referred to as the weft direction) are principle directions of the woven fabric. The warp direction 204 is the length wise, or machine direction (MD) of the fabric. The fill direction 202 is the direction across the fabric, from edge to edge, or the direction traversing the width of the weaving machine (i.e., the cross machine direction, CD). Thus, the warp and fill directions are generally perpendicular to each other. The set of yarns, threads, or monofilaments running in each direction are referred to as the warp yarns and the fill yarns, respectively. The woven pool cover fabric 200 includes one or more types of yarns, threads, and/or monofilaments in each of the warp direction 204 and fill direction 202.

The woven pool fabric 200 has a repeating geometric pattern with a plurality of first lines 210 in a warp direction 204 and plurality of second lines 212 in a fill direction 202 that cross one another to form a plurality of repeating geometric shapes, described below. In one or more embodiments, the first lines 210 in the warp direction 204 and the second lines 212 in the fill direction 202 cross one another to form perpendicular angles 220. In other embodiments, the first lines 210 in the warp direction 204 and the second lines in the fill direction 202 form angles that are not perpendicular and are therefore more than 90 degrees, less than 90 degrees, or oblique angles.

The crossing of the first lines 210 and second lines 212 form the repeating geometric pattern of plurality of geometric shapes. The plurality of geometric shapes is defined as a first geometric shape 214 and a second geometric shape 216 that alternate across each of the first lines 210 in the warp direction 204 and second lines 212 in the fill direction 202. Each first line 210 in the warp direction 204 includes alternating first geometric shape 214 and second geometric shape 216 in sequential order, i.e., first geometric shape 214, second geometric shape 216, first geometric shape 214, and second geometric shape 216. Each second line 212 in the weft direction also includes alternating first geometric shape 214 and second geometric shape 216 in sequential order, i.e., first geometric shape 214, second geometric shape 216, first geometric shape 214, and second geometric shape 216. In the repeating pattern, each first shape 214 is directly adjacent to a second shape 216 on all sides, such that first shapes 214 alternate with second shapes 216 in a repeating pattern in both the warp direction 204 and the fill direction 202. In embodiments, the first shape 214 does not directly contact another first shape 214 in another first line 210 or second line 212.

The resulting repeating pattern is a checkerboard pattern in one or more embodiments, with the same or different first and second geometric shapes 214, 216, with the sameness or differentness being the difference in size, shape, and/or weaving pattern, as further described below. In embodiments, the first geometric shape 214, the second geometric shape 216, or both, is, independently, a rectangle, a square, or a polygon. In FIG. 2, the first geometric shape 214 is a square, and the second geometric shape 216 is a square.

The first geometric shape 214 and the second geometric shape 216 have dimensions that are not intended to be limited and depend on the overall dimensions of the woven pool cover fabric and the pool onto which the fabric covers. In some embodiments, each of or both of the first geometric shape 214 and the second geometric shape 216 has perimeter dimensions of about 0.25 to about 3 inches in a first direction by about 0.25 to about 3 inches in a second direction. In other embodiments, the first geometric shape 214, the second geometric shape 216, or both, has a perimeter dimension about or in any range between about 0.25, 0.5, 0.75, 1, 1.25, 1.5, 1.75, 2, 2.25, 2.5, 2.75, and 3 inches in first direction. In other embodiments, the first geometric shape 214, the second geometric shape 216, or both, has a perimeter dimension about or in any range between about 0.25, 0.5, 0.75, 1, 1.25, 1.5, 1.75, 2, 2.25, 2.5, 2.75, and 3 inches in second direction. In one or more embodiments, the first direction is the warp direction 204, and the second direction is the fill direction 202. In other embodiments, the first direction is in direction that is offset or different from the warp direction 204, and the second direction is in a direction that is offset or different from the fill direction 210.

In embodiments, the first geometric shape 214 in a first line 210*a* of the plurality of first lines 210 is offset in the warp direction 204 with respect the first geometric shape 214 in a second line 210*b* of a plurality of first lines 210 that is successive with the first line 210*a* of the plurality of first lines 210. In embodiments, directly adjacent first lines 210*a*, 210*b* in a series of first lines 210 have first geometric shapes 214 that are offset in the warp direction 204 with respect to one another such that the first geometric shapes 214 are not directly adjacent to one another, or not stacked upon one another.

In embodiments, the second geometric shape 216 in the first line 210*a* of the plurality of first lines 210 is offset in the warp direction 204 with respect the second geometric shape 216 in the second line 210*b* of the plurality of second lines 210 that is successive with the first line 210*a* of the plurality of first lines 210. In embodiments, directly adjacent first lines 210*a*, 210*b* in a series of first lines 210 have second geometric shapes 216 that are offset in the warp direction 204 with respect to one another such that the second geometric shapes 216 are not directly adjacent to one another, or not directly stacked upon one another.

In some embodiments, each of the first geometric shape 214 and second geometric shape 216 are offset in warp direction 204 in the successive first and second lines 210*a*, 210*b* of the plurality of first lines 210 in the warp direction 204 by at least one pick. A "pick" is a single fill yarn.

In embodiments, the first geometric shape 214 in a first line 212*a* of the plurality of second lines 212 is offset in the fill direction 202 with respect the first geometric shape 214 in a second line 212*b* of a plurality of first lines 212 that is successive with the first line 212*a* of the plurality of second lines 212. In embodiments, directly adjacent first and second lines 212*a*, 212*b* in a series of second lines 212 have first geometric shapes 214 that are offset in the fill direction 202 with respect to one another such that the first geometric shapes 214 are not directly stacked upon one another, or not directly adjacent to one another.

In embodiments, the second geometric shape 216 in the first line 212*a* of the plurality of second lines 212 is offset in the fill direction 202 with respect the second geometric shape 216 in the second line 212*b* of the plurality of second lines 212 that is successive with the first line 212*a* of the plurality of second lines 212. In embodiments, directly adjacent first and second lines 212*a*, 212*b* in a series of second lines 212 have second geometric shapes 216 that are offset in the fill direction 202 with respect to one another such that the second geometric shapes 216 are not directly stacked upon one another, or not directly stacked upon one another.

In some embodiments, each of the first geometric shape 214 and second geometric shape 216 is offset in the successive first and second lines 212*a*, 212*b* of the plurality of second lines 212 in the fill direction 202 by at least one pick.

In embodiments, the first geometric shape 214 has a weave pattern that is different from a weave pattern of the second geometric shape 216. In other embodiments, the first geometric shape 214 has a weave pattern that is the same as the weave pattern of the second geometric shape 216. Non-limiting examples of weave patterns for each of the first geometric shape 214 and second geometric shape 216 are a plain weave pattern, a twill weave pattern, or a basket weave pattern. However, such patterns for the weave patterns of the first geometric shape 214 and second geometric shape 216 are only illustrative, and the invention is not limited to such patterns In one or more embodiments, the weave pattern of the first geometric shape 214, the second geometric shape 216, or both, is a ⅓ twill weave, a 2/1 twill weave, a 2/2 twill weave, or a 3/1 twill weave.

In embodiments, the first geometric shape 214 has a plain weave pattern, and the second geometric shape 216 has a twill weave pattern, which is a ⅓ twill weave, a 2/1 twill weave, a 2/2 twill weave, or a 3/1 twill weave.

The woven pool cover fabric is constructed so that the number of ends in the warp direction 204 is about 15 ends per inch to about 50 ends per inch. "Ends" refer to the number of yarns. In other embodiments, the number of ends in the warp direction 204 is about 30 ends per inch to about 45 ends per inch. In some embodiments, the number of ends in the warp direction 204 is about or in any range between about 15, 20, 25, 30, 35, 40, 45, and 50 ends per inch.

The fill 202 of the woven pool cover fabric has a number of picks in the range from about 8 per inch to about 40 per inch. "Picks" refer to the number of yarns. In other embodiments, the number of picks in the fill direction 202 is about 20 picks per inch to about 30 picks per inch. Yet, in other embodiments, the number of picks in the fill direction 202 is about or any range between about 8, 10, 12, 14, 16, 18, 20, 22, 24, 26, 28, 30, 32, 34, 36, 38, and 40 picks per inch.

The woven pool cover fabric has open channels through the fabric for water flow. Water flow rate, as referenced herein, is measured in accordance with ASTM D4491. In one or more embodiments, water flows through the fabric at a rate of about 10 and about 200 gallons/minute per square foot (gpm/ft$^2$). In some embodiments, the woven pool cover has a water flow rate of about 50 and about 150 gallons/minute per square foot (gpm/ft$^2$). In other embodiments, the woven pool cover fabric has a water flow rate of about or any range between about 10, 20, 30, 40, 50, 60, 70, 80, 90, 100, 110, 120, 130, 140, 150, 160, 170, 180, 190, and 200 gallons/minute per square foot (gpm/ft$^2$).

The woven pool cover fabric provides a shade coverage of about 80% to about 99% in some embodiments. Shade coverage is measured according to a test method based on ASTM D6567 Standard Test Method for Light Penetration of a Turf Reinforcement Mat (TRM), with the following modifications. The shade coverage test measures the percentage of direct light that a given fabric blocks or allows to pass through. Equipment used includes a shade box with a 150 Watt bulb and a calibrated light meter. A fabric sample size of 13×13 inches or larger is measured. The procedure includes turning the dimmer switch on and power on the light meter, and pressing the FC button. The light meter is adjusted to read 100% by turning the dimmer switch. The fabric is inserted so that the opening is completely covered. A reading (R) is taken from the light meter. The foregoing process is repeated for all specimens. The shade % is calculated using the following formula: % Shade=100−R, where R=reading on light meter. For light penetration, only R is recorded.

In other embodiments, the woven pool cover fabric provides a shade coverage of about 85% to about 95%. Still yet, in other embodiments, the woven pool cover fabric provides a shade coverage about or any range between about 80%, 91%, 82%, 83%, 84%, 85%, 86%, 87%, 88%, 89%, 90%, 91%, 92%, 93%, 94%, 95%, 96%, 97%, 98%, and 99%.

According to embodiments, the woven pool cover fabric has a MD tensile of about 200 pounds (lbs) to about 400 lbs as measured by ASTM D4632 test method. In other embodiments, the woven pool cover fabric has a MD tensile of about 250 lbs to about 350 lbs as measured by ASTM D4632 test method. Still in other embodiments, the woven pool cover fabric has a MD tensile about or in any range between about 200, 210, 220, 230, 240, 250, 260, 270, 280, 290, 300, 310, 320, 330, 340, 350, 360, 370, 380, 390, and 400 lbs, as measured by ASTM D4632 test method.

According to embodiments, the woven pool cover fabric has a CD tensile of about 125 lbs to about 425 lbs as measured by ASTM D4632 test method. In other embodiments, the woven pool cover fabric has a CD tensile of about 175 lbs to about 350 lbs as measured by ASTM D4632 test method. Still in other embodiments, the woven pool cover fabric has a CD tensile about or in any range between about 125, 150, 175, 200, 225, 250, 275, 300, 325, 350, 375, 400, and 425 lbs as measured by ASTM D4632 test method.

According to embodiments, the woven pool cover fabric has a MD trap tear of about 50 lbs to about 200 lbs as measured by ASTM D4533 test method. In other embodiments, the woven pool cover fabric has a MD trap tear of about 75 lbs to about 150 lbs as measured by ASTM D4533 test method. Still in other embodiments, the woven pool cover fabric has a MD trap tear about or in any range between about 50, 60, 70, 80, 90, 100, 110, 120, 130, 140, 150, 160, 170, 180, 190, and 200 lbs as measured by ASTM D4533 test method.

According to embodiments, the woven pool cover fabric has a CD trap tear of about 40 lbs to about 200 lbs as measured by ASTM D4533 test method. In other embodiments, the woven pool cover fabric has a CD trap tear of about 75 lbs to about 150 lbs as measured by ASTM D4533 test method. Still in other embodiments, the woven pool cover fabric has a CD trap tear about or in any range between about 40, 50, 60, 70, 80, 90, 100, 110, 120, 130, 140, 150, 160, 170, 180, 190, and 200 lbs as measured by ASTM D4533 test method.

According to embodiments, the woven pool cover fabric has a thickness of about 10 mils to about 30 mils as measured by ASTM D5199 test method. In other embodiments, the woven pool cover fabric has a thickness of about 15 mils to about 25 mils as measured by ASTM D5199 test method. Still in other embodiments, the woven pool cover fabric has thickness about or in any range between about 10, 11, 12, 13, 14, 15, 16, 17, 18, 19, 20, 21, 22, 23, 24, 25, 26, 27, 28, 29, and 30 mils as measured by ASTM D5199 test method.

According to embodiments, the woven pool cover fabric has a permeability of about 0.005 centimeters per second (cm/sec) to about 0.08 cm/sec as measured by ASTM D4491 test method. In other embodiments, the woven pool cover fabric has a permeability of about 0.01 cm/sec to about xx 0.06 cm/sec as measured by ASTM D4491 test method. Still in other embodiments, the woven pool cover fabric has a permeability about or in any range between about 0.005, 0.01, 0.015, 0.02, 0.025, 0.03, 0.035, 0.04, 0.045, 0.05, 0.055, 0.056, 0.07, 0.075, 0.08 cm/sec as measured by ASTM D4491 test method.

According to embodiments, the woven pool cover fabric has a permittivity of about 0.1 $sec^{-1}$ to about 1.2 $sec^{-1}$ as measured by ASTM D4491 test method. In other embodiments, the woven pool cover fabric has a permittivity of about 0.2 $sec^{-1}$ to about 1.0 $sec^{-1}$ as measured by ASTM D4491 test method. Still in other embodiments, the woven pool cover fabric has a permittivity about or in any range between about 0.1, 0.2, 0.3, 0.4, 0.5, 0.6, 0.7, 0.8, 0.9, 1.0, 1.1, 1.2 $sec^{-1}$ as measured by ASTM D4491 test method.

The woven pool cover fabric includes warp yarns in the warp direction 104 and fill yarns in the fill direction 102. The warp yarns, fill yarns, or both, are independently, a monofilament yarn, a tape yarn, or a fibrillated tape yarn.

The warp yarns and fill yarns include, independently, one or more polymers, including one or more synthetic polymers, including synthetic and/or biopolymers. The warp yarns and fill yarns include the same or different polymers, biopolymers, and/or blends thereof. Non-limiting examples of polymers and biopolymers include an acrylic acid polymer, an aramid polymer, a fluoropolymer, a high density polyetheylene, a low density polyethylene, a linear low density polyethylene, a polyacrylonitrile, a polyamide, a polybutylene terephthalate, a polybutylene adipate terephthalate (PBAT), a polybutylene succinate (PBS), a polycarbonate, a polyetherimide, a polyether ether ketone (PEEK), a polyester, a polyethylene copolymer, a polyethylene terephthalate, a polytetrafluoroethylene (PTFE), a polyvinylidine fluoride (PVDF), a polylactic acid (PLA), a polyhydroxyalkanoate (PHA), a polyamide, a polyimide, a polyolefin, a polyphenylene, a polyphenylene oxide, a polyphenylene sulfide, a polypropylene, a polypropylene/ethylene copolymer, a polystyrene, a polyurethane, an ultra-high molecular-weight polyethylene, a vinyl polymer, a starch, a polycaprolactone, a polyvinyl chloride (PVC), a polystyrene, a thermal plastic urethane (TPU), or any combination thereof.

The warp yarns and fill yarns have the same or different cross sectional shapes. In one or more embodiments, the warp yarns and fill yarns, independently, have a denier of about 150 to about 5000 denier. In other embodiments, the warp yarns and fill yarns, independently, have a denier of about 1000 to about 4000 denier. Still in other embodiments, the warp yarns and fill yarns, independently, have a denier of about or in any range between about 150, 250, 500, 750, 1000, 1250, 1500, 1750, 2000, 2250, 2500, 2750, 3000, 3250, 3500, 3750, 4000, 4250, 4500, 4750, and about 5000 denier.

According to one or more embodiments, a method of making a woven pool cover includes weaving a fabric. The fabric includes a repeating geometric pattern with plurality of first lines in a warp direction and plurality of second lines in a fill direction that cross one another to form a plurality of repeating geometric shapes. The plurality of geometric shapes include a first geometric shape and a second geometric shape that alternate across each of the first lines and second lines. The fabric has a water flow rate of about 10 gallons/minute per square foot to about 200 gallons/minute per square foot as measured by ASTM D4491 test and a shade coverage of about 80% to about 99%.

To form a fabric with a pattern of different weaves as described herein, any method may be used. In one or more embodiments, a plain weave portion of the repeating pattern of the fabric is a simple one warp end over one pick, under one pick repeating pattern. The twill weave (or other) portion of the repeating pattern of the fabric is different from the plain weave section, and can be a one warp end over two picks, under two picks, one warp end over one pick, under two picks, and many other combinations thereof. The two different weave sections are created by drawing the warp ends from each respective section on different loom harnesses. For example, the plain weave section would be drawn on two or four harnesses, independent from the loom harnesses of the twill or other weave section. The twill or other weave pattern would be drawn on multiple other harnesses separate from the plain weave section. As is commonly known by those of ordinary skill, each different weave section must be drawn on separate or independent harnesses so that those harnesses can be raised and lowered independently on the weaving loom in order to create the different weave patterns within the same fabric. Typically this would require the use of a dobby or jacquard weaving machine.

According to other embodiments, a method of covering a pool includes extending or laying a woven pool cover fabric over a pool opening. The fabric includes a repeating geometric pattern with plurality of first lines in a warp direction and plurality of second lines in a fill direction that cross one another to form a plurality of repeating geometric shapes. The plurality of geometric shapes include a first geometric shape and a second geometric shape that alternate across each of the first lines and second lines. The fabric has a water flow rate of about 10 gallons/minute per square foot to about 200 gallons/minute per square foot as measured by ASTM D4491 test and a shade coverage of about 80% to about 99%.

Examples

Pool covers of a control fabric and of an inventive fabric were woven and compared. The control fabric fibers and the inventive fabric fibers were made of polypropylene homopolymers. The mixtures were prepared on a lab extruder, without die (screw diameter 0.5 inch), and the temperature settings were constant for all trials.

As shown in Table 1, the control fabric had a higher water flow rate of 76 gpm/ft$^2$, while maintaining MD/CD tensile and elongation strengths and % shade coverage.

TABLE 1

Physical properties of control and inventive pool cover fabrics

| | Test Method | Control Fabric | Inventive Fabric |
|---|---|---|---|
| Warp Yarn | | 525 den mono | |
| Fill Yarn | | 565 den mono | |
| Construction | | 41 × 20 | 41 × 23 |
| Weight | D5621 | 4.8 | 5.1 |
| Grab Tensile, MD | D4632 | 335 | 330 |
| Grab Tensile, CD | | 182 | 184 |
| Grab Elong, MD | | 18.5 | 21.7 |
| Grab Elong, CD | | 24.4 | 24.4 |
| Trap Tear, MD | D4533 | 85 | 91 |
| Trap Tear, CD | D4533 | 63 | 62 |
| Thickness | D5199 | 12 | 16 |
| Shade % | | 95.0 | 94.2 |
| Water flow rate gpm/ft$^2$ | D4491 | 51 | 76 |
| Permeability | D4491 | 0.690 | 1.037 |
| Permittivity | D4491 | 0.020 | 0.042 |

Various embodiments of the present invention are described herein with reference to the related drawings. Alternative embodiments can be devised without departing from the scope of this invention. Although various connections and positional relationships (e.g., over, below, adjacent, etc.) are set forth between elements in the following description and in the drawings, persons skilled in the art will recognize that many of the positional relationships described herein are orientation-independent when the described functionality is maintained even though the orientation is changed. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the described structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, are connected without any intermediary conducting, insulating or semiconductor layers at the interface of the two elements.

The terms "about," "substantially," "approximately," and variations thereof, are intended to include the degree of error associated with measurement of the particular quantity based upon the equipment available at the time of filing the application. For example, "about" can include a range of +8% or 5%, or 2% of a given value.

The flowchart and block diagrams in the Figures illustrate possible implementations of fabrication and/or operation methods according to various embodiments of the present invention. Various functions/operations of the method are represented in the flow diagram by blocks. In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A woven pool cover fabric comprising:

a repeating geometric pattern with a plurality of first lines in a warp direction and a plurality of second lines in a fill direction that cross one another to form a plurality of repeating geometric shapes, the plurality of geometric shapes being a first geometric shape and a second geometric shape that alternate across each of the first lines and second lines;

a water flow rate of about 10 gallons/minute per square foot to about 200 gallons/minute per square foot as measured by ASTM D4491 test;

a shade coverage of about 80% to about 99%; and wherein the first geometric shape has a weave pattern that is different from a weave pattern of the second geometric shape; and wherein the first geometric shape in a first line of the plurality of first lines is offset with respect the first geometric shape in a second line of the plurality of first lines that is successive with the first line of the plurality of first lines; and the second geometric shape in the first line of the plurality of first lines is offset with respect the second geometric shape in the second line of the plurality of first lines that is successive with the first line of the plurality of first lines.

2. The woven pool cover fabric of claim 1, wherein each of the first geometric shape and the second geometric shape has, independently, a plain weave pattern, a twill weave pattern, or a basket weave pattern, wherein the first and second geometric shapes are offset by at least one pick.

3. The woven pool cover fabric of claim 2, wherein the twill weave pattern is a 1/3, 2/1, 2/2, or 3/1 twill weave pattern.

* * * * *